United States Patent [19]

Carden

[11] 4,089,561

[45] May 16, 1978

[54] CUTTER CHAINS HAVING PICKS AND TO PICKS THEREFOR

[75] Inventor: John Carden, Nassau, Bahamas

[73] Assignee: Gimda, Inc., Nassau, Bahamas

[21] Appl. No.: 729,866

[22] Filed: Oct. 5, 1976

[51] Int. Cl.[2] ..... E21C 25/42

[52] U.S. Cl. ..... 299/83; 125/21; 83/839

[58] Field of Search ..... 299/82–84; 125/21, 22; 83/839–844

[56] References Cited

U.S. PATENT DOCUMENTS 1,159,861 11/1915 Norris et al. ..... 299/84

2,675,219 4/1954 Proctor ..... 299/83

FOREIGN PATENT DOCUMENTS 665,900 1/1952 United Kingdom ..... 299/82

665,378 1/1952 United Kingdom ..... 299/83

*Primary Examiner*—J. M. Meister

*Attorney, Agent, or Firm*—Cushman, Darby & Cushman

[57] ABSTRACT

In an endless cutter chain having picks mounted on pick boxes, the picks have abutment portions so that angular movement of a pick and pick box in the plane of movement of the chain is limited by an abutment surface on one pick abutting against an abutment surface on the next adjacent pick in the chain.

6 Claims, 4 Drawing Figures

CUTTER CHAINS HAVING PICKS AND TO PICKS THEREFOR

BACKGROUND OF THE INVENTION

1. Field of the Invention

This invention relates to cutter chains having picks and to picks therefor.

2. Prior art

It is well known to use a continuously driven endless cutter chain formed of pick boxes carrying picks for cutting rock and for mining. Such a cutter chain may be used for example in a trench cutter, the cutter chain being mounted on a chain carrier which is lowered into the ground. The chain may be driven at a high speed for example more than 300 ft per minute and one of the problems with such cutter chains is the tendency of the pick to kick backwards as it cuts through strata of varying hardness and density. Thus a pick may be driven in a direction tending to dig deeply into the rock; this may result in the pick breaking or the chain stalling. For this reason, it is known to provide each pick box with a back stop limiting angular movement about an axis transverse to the plane of the endless chain. However the continuous peening action during operation on the stops on the pick boxes in such an arrangement results in the gradual change in the effective position of the stop and, since the angle of attack of the pick is critically dependent on the stop position, it is necessary that the pick boxes should be periodically replaced. This results in a very considerable increase in the maintenance work required on such cutter chains.

SUMMARY OF THE INVENTION

It is an object of the present invention to provide an improved form of cutter chain and of picks therefor avoiding the necessity for providing back stops on pick boxes.

According to the present invention, in an endless cutter chain having picks mounted on pick boxes, the picks are constructed to have abutment portions such that angular movement of a pick and pick box in the plane of movement of the chain is limited by an abutment surface on the pick abutting against an abutment surface on the next adjacent pick in the chain. By the plane of movement of the chain is meant the plane containing the paths of movement of the forward and return lengths of the chain. Preferably each pick has a portion extending rearwardly from the cutting edge of the pick to a position adjacent the forward end of the next pick in the rearward direction, one abutment surface being formed on the rearward end of said rearwardly extending portion and the other on the forward end of the pick. These portions extending rearwardly and forwardly of the cutting edge ride over the rock face and are preferably curved in all directions to provide a smoothly rounded surface which will slide over the rock. These portions are conveniently arranged to limit the depth of penetration of the cutting edge of the pick. This is of particular importance when cutting very hard rocks such as granite or hard limestone; such rocks can be cut provided the depth of penetration is limited to an amount dependent on the strength of the pick, the speed and torque or force on the cutter chain, the rake of the cutter tooth and the type of rock. If the depth of penetration should increase beyond the limits permitted by these parameters, the pick will break or the machine will stall. By limiting the depth of penetration, continuous operation can be ensured. The picks, with their rearwardly extending portions, form in effect a continuous bar which is presented to the rock face being cut, since each pick touches the next. This avoids the possibility of a pick getting caught in a void in the rock face.

Compared with the use of back stops on the pick boxes, the abutment surfaces in the arrangement of the present invention can readily be positioned much further forward and much further away from the back pin centres so giving much greater efficiency.

Preferably therefore the pick has a cutter edge or edges or tips protruding from a rounded body member which body member extends rearwardly (to constitute the aforesaid forwardly extending portion) to terminate in an abutment surface for abutting against an abutment surface on the next pick along the chain.

The invention furthermore includes within its scope a pick for a cutter chain comprising a shank with an elongated body portion extending substantially at right angles to the shank, the body portion having abutment surfaces at its two ends, said elongated body portion furthermore having rounded surfaces in planes transverse to its length and a cutter or cutters mounted in said body portion to protrude therefrom. Conveniently two cutter edges, for example of tungsten carbide material, are arranged side by side in said body portion.

DESCRIPTION OF THE PREFERRED EMBODIMENTS

Figure 1:
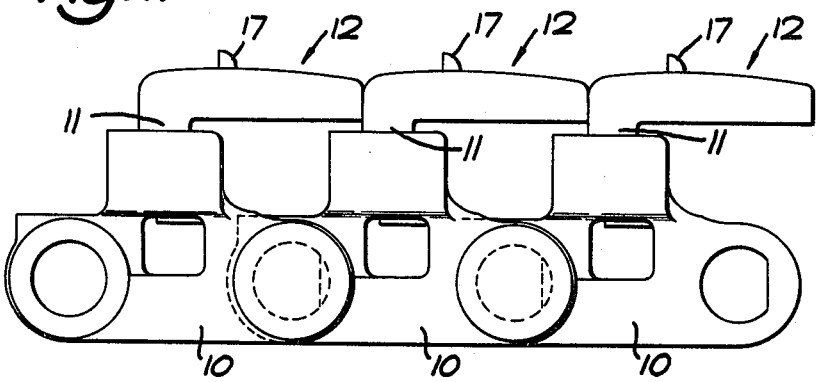
FIG. 1 is a side elevation of part of a cutter chain having picks mounted on pick boxes and illustrating an embodiment of the invention.

Referring to the drawings, FIG. 1 shows a cutter chain having pick boxes 10 in each of which is mounted the shank 11 of a pick 12. Each pick has an elongated body portion 13 terminating in abutment surfaces 14 and 15 which co-operate with the abutment surfaces on adjacent picks.

Figure 2:
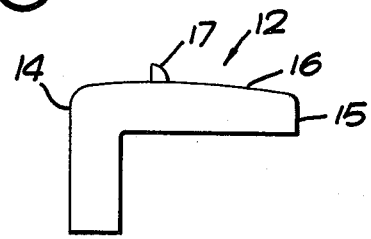
FIG. 2 is a side elevation of a pick used in the cutter chain of FIG. 1.
Figure 3:
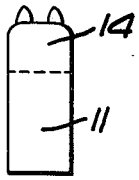
FIGS. 3 and 4 are respectively a front elevation and plan view of the pick of FIG. 2.
Figure 4:
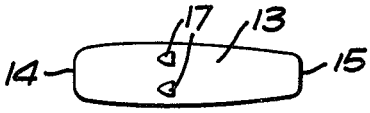

Referring more particularly to FIGS. 2, 3 and 4, the shank 11 of the pick may be of square or rectangular section in accordance with known practice. Extending substantially at right angles to this shank and in a direction parallel to the length of the chain is the elongated body portion 13 which is slightly curved as shown at 16 to provide a smooth surface for riding over the rock face. In planes transverse to the direction of movement, the body portion 13 is also smoothly curved. In this particular embodiment there are a pair of cutting tips 17 formed by hard metal or tungsten carbide inserts in the body portion 13 having edges protruding beyond the smooth surface of the body portion by an amount chosen in accordance with the required depth of penetration. The body portion 13 is terminated by the flat abutment surfaces 14, 15. Any tendency for a pick and pick box to swing in a direction such that the pick would tend to dig into the rock causes the front abutment surface 14 of that pick to hit against the rear abutment surface 15 of the next pick. Because of the leverage involved, peening of these abutment surfaces will have little effect on the required limitation of angular movement of the picks and pick boxes. This results in much greater efficiency compared with prior constructions using back stops on the pick boxes. Moreover with the construction described above there is a considerable saving in labour and cost in that it is not necessary to change the pick boxes because of back stop wear. The picks themselves have, in any case, to be changed because of wear on the cutter edge.

The successive picks on a cutter chain are usually laced, that is set at an angle so that they cut along slightly different parallel lines, the overall effect of the cutting by successive picks being to cut a kerf of the required width. By doing this the kerf is made wide enough to admit the cutter chain and its carrier. The abutment surfaces of the picks have to be sufficiently wide that the adjacent picks will abut one another despite the radial offsets required for such lacing of the picks on the chain.

I claim:

1. In an endless cutter chain having picks mounted on pick boxes, each pick comprising a body portion with an integral shank having at least one cutting edge protruding from said body portion, the improvement wherein the picks are constructed to have abutments on said body portions such that angular movement of a pick and pick box in the plane of movement of the chain is limited by an abutment surface on the pick abutting against an abutment surface on the next adjacent pick in the chain.

2. An endles cutter chain as claimed in claim 1 wherein each pick has a portion extending rearwardly from the cutting edge of the pick to a position adjacent the forward end of the next pick in the rearward direction, one abutment surface being formed on the rearward end of said rearwardly extending portion and the other on the forward end of the pick.

3. An endless cutter chain as claimed in claim 2 wherein each said portion is arranged to limit the depth of penetration of the cutting edge of the pick.

4. An endless cutter chain as claimed in claim 1 wherein each pick has at least one cutter edge protruding from a rounded body member which body member extends rearwardly to terminate in an abutment surface for abutting against an abutment surface for abutting against an abutment surface on the next pick along the chain.

5. An endless cutter chain comprising pick boxes pivotally interconnected chain-wise and a pick in each pick box, each said pick comprising a shank with an elongated body portion, the picks being mounted in the pick boxes so that the shanks extend outwardly substantially at right angles to the chain direction with said elongated portions remote from the pick boxes but with said elongated body portions aligned lengthwise of the chain, each of said elongated body portions having an abutment surface at each of its ends to abut against an abutment surface of the next adjacent pick, each said body portion further having at least one cutter mounted in the body portion to protrude therefrom.

6. An endless cutter chain as claimed in claim 5 wherein each said elongated body portion has rounded surfaces in planes transverse to its length.

* * * * *